US007103976B2

(12) United States Patent
Pennella

(10) Patent No.: US 7,103,976 B2
(45) Date of Patent: Sep. 12, 2006

(54) RAZOR ASSEMBLY

(75) Inventor: Andrew Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/773,586

(22) Filed: Feb. 6, 2004

(65) Prior Publication Data

US 2005/0172495 A1 Aug. 11, 2005

(51) Int. Cl.
*B26B 21/00* (2006.01)

(52) U.S. Cl. ..... 30/32; 30/50; 30/526; 30/527

(58) Field of Classification Search ..... 30/41, 30/47, 50, 526, 527, 32
See application file for complete search history.

(56) References Cited

U.S. PATENT DOCUMENTS

| | | | | |
|---|---|---|---|---|
| 330,418 | A | 11/1885 | Partridge et al. | |
| 951,036 | A | 3/1910 | Waterman | |
| 1,342,028 | A | 6/1920 | Nordskog | |
| 1,543,387 | A | 6/1925 | Kawalle | |
| 1,744,280 | A | 1/1930 | Peterson | |
| 1,768,307 | A | 6/1930 | Bleloch et al. | |
| 1,836,800 | A | 12/1931 | Hope | |
| 2,183,554 | A | 12/1939 | Evans | 30/84 |
| 2,614,321 | A | 10/1952 | Ackeman | |
| 2,839,224 | A | 6/1958 | Lipka | |
| 3,378,922 | A | 4/1968 | Schrader et al. | 30/66 |
| 3,477,127 | A | 11/1969 | Regan | |
| 3,488,764 | A | 1/1970 | Welsh | 30/50 |
| 3,675,323 | A | 7/1972 | Braginetz | 30/32 |
| 3,702,026 | A | 11/1972 | Scholin | |
| 3,703,764 | A | 11/1972 | Perry | 30/32 |
| 3,703,765 | A | 11/1972 | Perez | |
| 3,724,070 | A | 4/1973 | Dorion, Jr. | 30/47 |
| 3,786,563 | A | 1/1974 | Dorion, Jr. et al. | 30/50 |
| 3,832,774 | A | 9/1974 | Perry | 30/32 |
| 3,871,077 | A | 3/1975 | Nissen et al. | |
| 3,895,437 | A | 7/1975 | DiBuono | |
| 3,934,338 | A | 1/1976 | Braginetz | 30/47 |
| 3,935,639 | A | 2/1976 | Terry et al. | |

(Continued)

FOREIGN PATENT DOCUMENTS

| | | |
|---|---|---|
| BE | 509715 | 3/1952 |

(Continued)

OTHER PUBLICATIONS

Copy of European Search Report for Serial No. EP 0 1300318 dated May 23, 2001.

(Continued)

*Primary Examiner*—Timothy V. Eley
*Assistant Examiner*—Jason Prone
(74) *Attorney, Agent, or Firm*—Michaud-Duffy Group LLP

(57) ABSTRACT

A razor assembly is provided that includes a razor cartridge with one or more razor blades, a shaving aid body, a handle, and a linkage pivotally connected to the handle. The linkage is connected to the razor cartridge and the shaving aid body in a manner such that the razor cartridge and the shaving aid body are moveable relative to the handle. Movement of one of the razor cartridge or the shaving aid body in a first direction causes the other of the razor cartridge or the shaving aid body to move in a second direction substantially opposite the first direction. As a result, the positions of the shaving aid body and the razor cartridge are continuously adjusted to maintain the contact surface of the shaving aid body approximately co-planar with the cutting edges of the razor blades within the razor cartridge.

13 Claims, 4 Drawing Sheets

U.S. PATENT DOCUMENTS

| | | | | |
|---|---|---|---|---|
| 3,969,817 | A | 7/1976 | DiBuono | |
| 4,074,429 | A | 2/1978 | Roberts | 30/41 |
| 4,170,821 | A | 10/1979 | Booth | |
| 4,241,500 | A | 12/1980 | Iten | |
| 4,314,404 | A | 2/1982 | Ruiz et al. | 30/41 |
| 4,336,651 | A | 6/1982 | Caro | 30/49 |
| 4,389,773 | A | 6/1983 | Nissen et al. | 30/50 |
| 4,407,067 | A | 10/1983 | Trotta | 30/50 |
| 4,442,598 | A | 4/1984 | Jacobson | 30/47 |
| 4,443,940 | A | 4/1984 | Francis et al. | 30/50 |
| 4,483,068 | A | 11/1984 | Clifford | |
| 4,534,110 | A | 8/1985 | Glass | 30/346.57 |
| 4,535,537 | A | 8/1985 | Ferraro et al. | 30/32 |
| 4,562,644 | A | 1/1986 | Hitchens | 30/41 |
| 4,573,266 | A | 3/1986 | Jacobson | 30/41 |
| 4,586,255 | A | 5/1986 | Jacobson | 30/41 |
| 4,587,729 | A | 5/1986 | Jacobson | |
| 4,595,124 | A | 6/1986 | Duval et al. | |
| 4,621,424 | A | 11/1986 | Jacobson | 30/41 |
| 4,624,051 | A | 11/1986 | Apprille, Jr. et al. | 30/50 |
| 4,709,476 | A | 12/1987 | Shurtleff et al. | |
| 4,712,300 | A | 12/1987 | Hemmeter | |
| D298,068 | S | 10/1988 | Gilder | D28/47 |
| 4,778,640 | A | 10/1988 | Braun et al. | |
| 4,807,360 | A | 2/1989 | Cerier et al. | 30/49 |
| 4,850,106 | A | 7/1989 | Braun et al. | |
| 4,875,288 | A | 10/1989 | Trotta et al. | 30/49 |
| 4,893,641 | A | 1/1990 | Strickland | |
| 4,901,437 | A | 2/1990 | Iten | 30/50 |
| 4,944,090 | A | 7/1990 | Sumnall | 30/41 |
| 4,964,214 | A | 10/1990 | Welsh et al. | |
| 4,970,784 | A | 11/1990 | Althaus et al. | 30/89 |
| 4,977,670 | A | 12/1990 | Iten | |
| 4,979,298 | A | 12/1990 | Pesiri | |
| 4,984,365 | A | 1/1991 | Leonard et al. | |
| 5,005,287 | A | 4/1991 | Ritter | 30/41 |
| 5,031,318 | A | 7/1991 | Brown et al. | |
| 5,036,587 | A | 8/1991 | Trotta et al. | |
| 5,056,222 | A | 10/1991 | Miller et al. | |
| 5,063,667 | A | 11/1991 | Jacobson | |
| 5,063,669 | A | 11/1991 | Althaus | 30/77 |
| 5,079,839 | A | 1/1992 | Conrad, Jr. et al. | |
| 5,084,968 | A | 2/1992 | Trotta | 30/47 |
| 5,121,541 | A | 6/1992 | Patrakis | |
| 5,134,775 | A | 8/1992 | Althaus et al. | |
| 5,141,349 | A | 8/1992 | Maguire, Jr. et al. | |
| 5,161,307 | A | 11/1992 | Althaus | 30/77 |
| 5,191,712 | A | 3/1993 | Crook et al. | 30/34.2 |
| 5,249,361 | A | 10/1993 | Apprille, Jr. et al. | 30/77 |
| 5,265,759 | A | 11/1993 | Coffin | 221/123 |
| 5,319,852 | A | 6/1994 | Metzger | |
| 5,347,714 | A | 9/1994 | Prochaska | |
| 5,369,885 | A | 12/1994 | Ferraro | 30/41 |
| 5,430,939 | A | 7/1995 | Johnston | 30/41 |
| 5,461,782 | A | 10/1995 | Rauch | |
| 5,463,813 | A | 11/1995 | Otsuka et al. | 30/43.9 |
| 5,490,329 | A | 2/1996 | Chvlinski et al. | |
| 5,493,778 | A | 2/1996 | Ichivanaoi | |
| 5,497,550 | A | 3/1996 | Trotta et al. | 30/50 |
| 5,517,760 | A | 5/1996 | Prochaska | |
| D373,218 | S | 8/1996 | Shurtleff et al. | D28/44 |
| 5,579,580 | A | 12/1996 | Althaus et al. | |
| 5,604,983 | A | 2/1997 | Simms et al. | |
| 5,666,729 | A | 9/1997 | Ferraro | 30/50 |
| D403,811 | S | 1/1999 | Brown et al. | D28/47 |
| 5,903,979 | A | 5/1999 | Oldroyd | |
| 5,953,825 | A | 9/1999 | Christman et al. | 30/527 |
| 5,956,849 | A | 9/1999 | Chadwick et al. | |
| D415,315 | S | 10/1999 | Swanson et al. | D28/47 |
| D416,108 | S | 11/1999 | Shurtleff et al. | |
| 6,149,981 | A | 11/2000 | Chadwick et al. | |
| 6,161,287 | A | 12/2000 | Swanson et al. | |
| 6,185,823 | B1 | 2/2001 | Brown et al. | |
| 6,295,734 | B1 | 10/2001 | Gilder et al. | 30/50 |
| 6,298,557 | B1 | 10/2001 | Gilder et al. | 30/34.2 |
| 6,298,558 | B1 | 10/2001 | Tseng et al. | 30/41 |
| 6,308,416 | B1 | 10/2001 | Bosy et al. | 30/50 |
| 6,430,818 | B1 | 8/2002 | Wonderley | |
| 6,442,839 | B1 | 9/2002 | Tseng et al. | |
| 6,502,318 | B1 | 1/2003 | Gilder | 30/530 |
| 6,568,082 | B1 | 5/2003 | Pouettre et al. | |
| 6,584,690 | B1 | 7/2003 | Orloff et al. | |
| 6,594,904 | B1 | 7/2003 | Tseng | |
| 6,807,739 | B1 | 10/2004 | Follo | |
| 6,886,254 | B1 * | 5/2005 | Pennella | 30/41 |
| 2003/0200660 | A1 * | 10/2003 | Pennella et al. | 30/47 |

FOREIGN PATENT DOCUMENTS

| | | |
|---|---|---|
| DE | 319832 | 2/1919 |
| DE | G 87 17 729.3 | 9/1989 |
| EP | 0 276 066 | 1/1988 |
| EP | 0 477 132 B1 | 3/1992 |
| EP | 0 453 906 B1 | 11/1992 |
| EP | 1 125 697 A1 | 8/2001 |
| FR | 482 302 | 3/1917 |
| FR | 806 899 | 12/1936 |
| FR | 1484360 | 6/1967 |
| FR | 1 503 887 | 12/1967 |
| GB | 409 902 | 5/1934 |
| GB | 1 432 182 | 4/1976 |
| GB | 1 572 442 | 7/1980 |
| GB | 2 042 959 A | 10/1980 |
| GB | 2116470 | 9/1983 |
| JP | 4-361783 | 12/1992 |
| WO | WO 91/01204 | 2/1991 |
| WO | WO 96/02369 | 2/1996 |
| WO | 98/36878 | 8/1998 |

OTHER PUBLICATIONS

Copy of PCT Search Report for Serial No. PCT/IB03/01144 dated Oct. 29, 2003.

* cited by examiner

RAZOR ASSEMBLY

BACKGROUND OF THE INVENTION

1. Technical Field

This invention relates to shaving devices in general, and to shaving devices that include a shaving aid in addition to one or more razor blades in particular.

2. Background Information

Modern safety razors include a plurality of razor blades disposed within a cartridge that is pivotally or rigidly mounted on a handle. Each of the razor blades has a cutting edge that is contiguous with a shave plane. Some safety razors (also referred to hereinafter as razor assemblies) have a disposable cartridge for use with a reusable handle, while others have a handle and cartridge that are combined into a unitary disposable. Razor cartridges often include a strip comprised of shaving aids (e.g., lubricating agents, drag reducing agents, depilatory agents, cleaning agents, medicinal agents, skin conditioning assets, etc.) disposed aft of the razor blades to enhance the shaving process. The terms "forward" and "aft", as used herein, define relative position between features of the safety razor. A feature "forward" of the razor blades, for example, is positioned so that the surface to be shaved encounters the feature before it encounters the razor blades, if the razor assembly is being stroked in its intended cutting direction (e.g., a guard is typically disposed forward of the razor blades). A feature "aft" of the razor blades is positioned so that the surface to be shaved encounters the feature after it encounters the razor blades, if the razor assembly is being stroked in its intended cutting direction (e.g., the aforesaid shaving aid strip disposed aft of the razor blades).

Most safety razors are designed for use with a shaving preparation. The shaving preparation (e.g., shaving cream) is applied to the skin and remains there until it is removed during the shaving process, or washed off thereafter. Although shaving preparations desirably enhance the shaving process, they also have undesirable aspects. For example, shaving cream is impractical in a wet shaving environment because the shaving cream is often washed away before the shaving process can be completed. In addition, shaving cream is an item independent of the razor that must be purchased and stored by the user; i.e., one more item to store in the bathroom.

What is needed, therefore, is a razor assembly that can be used with a shaving preparation without the above-identified problems, and one that can be used in a shower/wet environment.

DISCLOSURE OF THE INVENTION

According to the present invention, a razor assembly is provided that includes a razor cartridge that includes one or more razor blades, a shaving aid body, a handle, and a linkage having a first member, a second member, and a pivot member. The razor cartridge is selectively attached to the first member, and the shaving aid body is selectively attached to the shaving aid body. The first member and the second member are each pivotally attached to the handle. The pivot member is pivotally attached to the handle, the first member, and the second member in a manner that enables the razor cartridge and the shaving aid body to be moveable relative to the handle. Movement of one of the razor cartridge or the shaving aid body in a first direction causes the other of the razor cartridge or the shaving aid body to move in a second direction substantially opposite the first direction.

An advantage of the present invention is the ease of use and safety provided by the positional self-adjustment of the shaving aid body and the razor cartridge provided by the present invention. The linkage of the present invention, and the self-adjusting movement it provides, enables the relative positions of the shaving aid body and the razor cartridge to be continuously adjusted so that a desirable orientation between the contact surface of the shaving aid body and the cutting edges of the razor blades within the razor cartridge can be maintained automatically during the shaving process. The linkage is connected to the razor cartridge and to the shaving aid body in such a manner that movement of one of the razor cartridge or the shaving aid body in a first direction causes the other of the razor cartridge or the shaving aid body to move in a second direction substantially opposite the first direction. A change in the height of the shaving aid body (and therefore the position of the contact surface), for example, can be accommodated automatically relative to the position of the razor blades within the razor cartridge.

Another advantage of the present invention is that a shaving aid can be applied during the shaving process. As a result, the shaving aid within the shaving aid body can be successfully applied and utilized within a wet shaving environment. The need for an independent source of shaving cream or other shaving preparation, and the clutter and mess associated therewith, is consequently eliminated.

These and other objects, features, and advantages of the present invention will become apparent in light of the detailed description of the present invention.

DETAILED DESCRIPTION OF THE INVENTION

Figure 1:
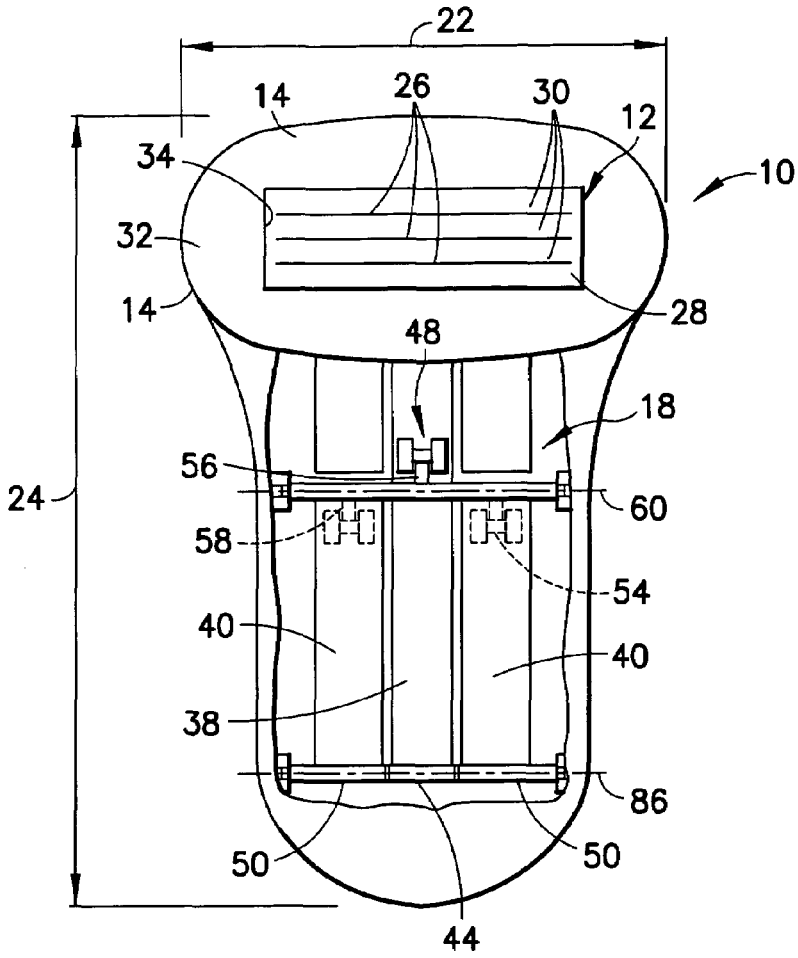
FIG. 1 is a diagrammatic front view of a present invention razor assembly, partially broken away to illustrate a linkage embodiment.

Now referring to FIGS. 1–5, the present invention razor assembly 10 includes a razor cartridge 12, a shaving aid body 14, a handle 16, and a linkage 18. The razor assembly 10 can be described as having a width 20, a length 22, and a height 24.

The razor cartridge 12 includes one or more razor blades 26 attached to a frame 28. Each of the razor blades 26 has a cutting edge 30. The razor cartridge 12 is connected to the linkage 18 as will be described in more detail below.

The shaving aid body 14, which includes a contact surface 32, is an erodable solid body that comprises one or more shaving aid materials (e.g., lubricating agents, drag reducing agents, depilatory agents, cleaning agents, medicinal agents, skin conditioning agents, etc.) to enhance the shaving process. The shaving aid body 14 is not limited to any particular type of shaving aid material, but rather can be selectively formulated to suit the application at hand. A solid soap material is an example of an acceptable shaving aid material for use in a wet shaving environment. In FIGS. 1–5, the shaving aid body 14 is shown as a single oval having a center aperture 34 in which the razor cartridge 12 is disposed. In alternative embodiments, the shaving aid body 14 can comprise one or more sections adjacent the razor cartridge 12; e.g., a forward portion, an aft portion, and/or side portions. Typically, but not necessarily, the shaving aid body 14 is mounted on a base 36 configured to support the shaving aid body 14. For those embodiments that do include a base 36, the shaving aid body 14 may be produced with the base 36 or it may be produced separately from the base 36 and subsequently attached. Examples of the present invention shaving aid body 14 and base 36 are disclosed in U.S. patent application Ser. No. 10/367,255 filed on Feb. 14, 2003, which is hereby incorporated by reference herein.

Figure 2:
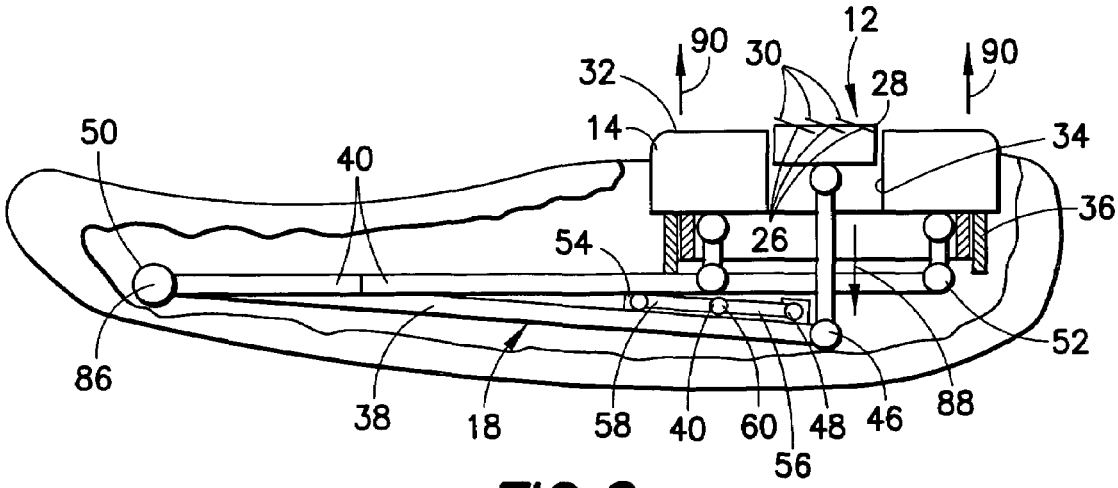
FIG. 2 is a diagrammatic side view of the present invention razor assembly with a linkage embodiment shown in a first position.
Figure 3:
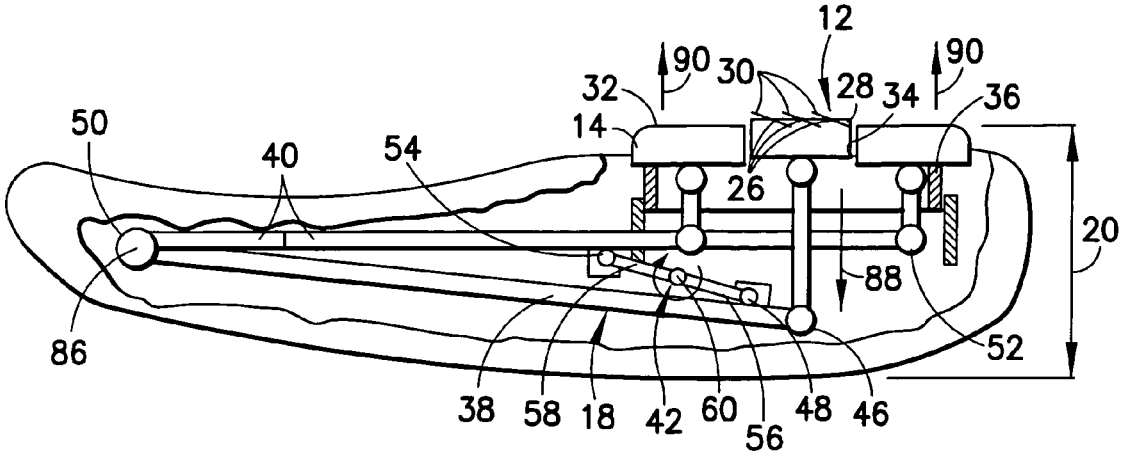
FIG. 3 is a diagrammatic side view of the present invention razor assembly with a linkage embodiment shown in a second position, illustrating the shaving aid body in an eroded state.

Referring to FIGS. 1–3, a first embodiment of the linkage 18 includes a first link 38, a second link 40, and a pivot link 42. The first link 38 includes a pivot end 44, a cartridge end 46, and at least one pivot mount 48 disposed therebetween. The pivot end 44 of the first link 38 is pivotally attached to the handle 16. The cartridge end 46 of the first link 38 is connected to the razor cartridge 12. The second link 40 includes a pivot end 50, a body end 52, and at least one pivot mount 54 disposed therebetween. The pivot end 50 of the second link 40 is pivotally attached to the handle 16. The body end 52 of the second link 40 is connected to the shaving aid body 14. The pivot link 42 includes at least one first-link arm 56, at least one second-link arm 58, and an axis of rotation 60. In the embodiment shown in FIGS. 1–3, the first-link arm 56 and second-link arm 58 extend outwardly on opposite sides of the axis of rotation 60. The first-link arm 56 and the second-link arm 58 may be disposed circumferentially closer to one another in alternative embodiments. The first-link arm(s) 56 and the pivot mount(s) 48 of the first link 38 are engageable with each other to form a pivotable connection therebetween. The second-link arm(s) 58 and the pivot mount(s) 54 of the second link 40 are engageable with each other to form a pivotable connection therebetween. The pivotal connections between the arms 56,58 and the pivot mounts 48, 54 can assume a variety of different configurations (e.g., ball and socket, etc.) and are not, therefore, limited to any particular configuration.

Referring to FIGS. 4–7, a second embodiment of the linkage 18 includes a first link 38, a second link 40, and a pivot link 42. The first link 38 includes a pivot end 44, a cartridge end 46, and at least one pivot mount 48 disposed therebetween. The pivot end 44 of the first link 38 is pivotally attached to the handle 16. The cartridge end 46 of the first link 38 is connected to the razor cartridge 12. The second link 40 includes a pivot end 50, a body end 52, and at least one pivot mount 54 disposed therebetween. The pivot end 50 of the second link 40 is pivotally attached to the handle 16. The body end 52 of the second link 40 is connected to the shaving aid body 14. The pivot link 42 includes at least one first-link arm 56, at least one second-link arm 58, and an axis of rotation 60. In the embodiment shown in FIGS. 4–7, the first-link arm 56 and second-link arm 58 extend outwardly on opposite sides of the axis of rotation 60. The first-link arm 56 and the second-link arm 58 may be disposed circumferentially closer to one another in alternative embodiments. The first-link arm(s) 56 and the pivot mount(s) 48 of the first link 38 are engageable with each other to form a pivotable connection therebetween. The second-link arm(s) 58 and the pivot mount(s) 54 of the second link 40 are engageable with each other to form a pivotable connection therebetween. The pivotal connections between the arms 56,58 and the pivot mounts 48, 54 can assume a variety of different configurations (e.g., ball and socket, etc.) and are not, therefore, limited to any particular configuration.

Referring to FIGS. 1–7, the linkage 18 connects to the razor cartridge 12, shaving aid body 14, and handle 16 in such a manner that movement of one of the razor cartridge 12 or the shaving aid body 14 in a first direction causes the other of the razor cartridge 12 and the shaving aid body 14 to move in a second direction substantially opposite the first direction. This relative movement may be referred to as a "seesaw" type movement.

In the embodiment shown in FIGS. 1–3, for example, the pivot ends 44, 50 of the first and second links 38, 40 are shown aligned and pivotally attached to the handle 16 about a common axis 86. The pivot ends 44, 50 can be positioned adjacent but apart from one another (e.g., parallel and spaced apart) in alternative embodiments. The first link 38 is shown disposed between two second links 40. The pivot link 42 is pivotally attached to the handle 16 at a position disposed between the pivot ends 44, 50 and the opposite cartridge end 46 and body end 52 of the respective first and second links 38, 40.

In the embodiment shown in FIGS. 1–3, clockwise rotation of the first link 38 about its pivot end 44 causes the pivot link 42 to rotate in a clockwise direction about its axis of rotation 60. The clockwise rotation of the pivot link 42, in turn, causes the second link 40 to rotate in a counterclockwise direction about its pivot end 50. As a result, the razor cartridge 12 attached to the first link 38 moves in first direction (depicted by arrow 88) and the shaving aid body 14 attached to the second link 40 moves in a second direction (depicted by arrows 90) that is substantially opposite the first direction. In a similar manner, counterclockwise rotation of the first link 38 causes the second link 40 to rotate in a clockwise direction. In this embodiment, the axis of rotation 60 of the pivot link 42 is substantially parallel to the axis(es) 86 about which the pivot ends 44,50 of the links 38,40 rotate.

In the embodiment shown in FIGS. 4–7, clockwise rotation of the first link 38 about its pivot end 44 (FIG. 6) causes the pivot link 42 to rotate in a clockwise direction about its axis of rotation 60. The clockwise rotation of the pivot link 42, in turn, causes the second link 40 to rotate in a counterclockwise direction about its pivot end 50. As a result, the first link 38 moves in first direction (depicted by arrow 92) and the second link 40 moves in a second direction (depicted by arrow 94) that is substantially opposite the first direction. In a similar manner, rotation of the first link 38 in a counterclockwise direction (FIG. 7) causes the second link 40 to rotate in a clockwise direction. As a result, the first link 38 moves in first direction (depicted by arrow 98) and the second link 40 moves in a second direction (depicted by arrow 96) that is substantially opposite the first direction. In the embodiment shown in FIGS. 4–7, the axis of rotation 60 of the pivot link 42 is substantially perpendicular to the axis(es) 86 about which the pivot ends 44,50 of the links 38,40 rotate.

The consequence of the above-described "seesaw" movement is that the contact surface 32 of the shaving aid body 14 can be maintained approximately co-planar with the cutting edges 30 of the razor blades 26 within the razor cartridge 12.

The pivotal connections between the first link 38 and the razor cartridge 12, and between the second link 40 and the shaving aid body 14, can be direct or indirect. In a direct pivotal connection, the link 38,40 is directly connected to the respective razor cartridge 12 or shaving aid body 14. In an indirect connection, one or more intermediate members are disposed between the link 38,40 and the respective razor cartridge 12 or shaving aid body 14. For example, it is disclosed above that the shaving aid body 14 is typically mounted on a base 36 for support. In such an arrangement the second link 40 is pivotally attached to the base 36 or other intermediate member rather than directly to the shaving aid body 14. Hence, the second link 40 is indirectly pivotally connected to the shaving aid body 14.

The relative positioning of the pivot ends 44,50 and the pivot link 42 within the handle 16 can be manipulated to add mechanical advantage and/or the relative amounts of travel of the attached razor cartridge 12 or shaving aid body 14. The exact relative positioning of the pivot link 42 pivot point and the pivot end 44,50 pivot points can be chosen to suit the application at hand.

The term "approximately co-planar", as used herein, is used to describe any and all relative positions of the shaving aid body 14 and the razor cartridge 12 wherein the surface to be shaved (e.g., compliant skin) can be in contact with the contact surface 32 of the shaving aid body 14 and the cutting edges 30 of the razor blades 26.

The area of the shaving aid body 14 contact surface 32 is selectively sized relative to the surface area of the razor cartridge 12 that is intended to be in contact with the surface to be shaved (referred to hereafter as the "razor cartridge contact surface area"). During the shaving process, the user forces the razor assembly 10 against the surface to be shaved. The force, which can be described in terms of pressure (force per unit surface area), is uniformly applied to the shaving aid body 14 and the razor cartridge 12. If the surface area of the shaving aid body contact surface 32 and the razor cartridge surface area are equal, then the force applied by the user against the shaving aid body 14 and the razor cartridge 12 will likely also be equal. On the other hand, if the surface area of the shaving aid body contact surface 32 exceeds that of the razor cartridge 12, the force transmitted to the linkage 18 via the shaving aid body 14 will exceed that transmitted to the linkage 18 via the razor cartridge 12. As a result, the razor cartridge 12 will be biased towards the surface to be shaved. Hence, the surface area of the shaving aid body contact surface 32 is selectively sized relative to the razor cartridge contact surface 32 area to provide a desirable result.

The relative sizing of the surface areas of the shaving aid body contact surface 32 and the razor cartridge contact area can be selectively chosen in combination with the above described relative positioning of the pivot link 42 pivot point and the pivot end 44,50 pivot points to either cancel out mechanical advantage or to add mechanical advantage.

The handle 16 can include, but is not limited to, a stem, or a body having an internal cavity, or some combination thereof. The preferred handle 16 includes an ergonomic body that includes an internal cavity for housing the linkage 18 and in some instances a portion of the shaving aid body 14. The ergonomic shape of the body facilitates the use of the razor assembly. As stated above, the handle 16 includes a pivotal connection to the first link 38, second link 40, and the pivot link 42. The pivotal connections between the handle 16 and the links 38,40,42 can assume a variety of different configurations (e.g., ball and socket, etc.) and are not, therefore, limited to any particular configuration.

During operation of the razor assembly 10, the razor cartridge 12 is typically initially positioned such that the cutting edges 30 of the one or more razor blades 26 within the razor cartridge 12 are approximately co-planar with the contact surface 32 of the new shaving aid body 14. During use, the razor assembly 10 is exposed to water and the razor assembly 10 is drawn along the surface to be shaved. As a result, the shaving aid body 14 begins to erode and provide, for example, a lubricating medium for the surface to be shaved. As the user shaves, the erosion of the shaving aid body 14 causes the shaving aid body 14 to decrease in height. Absent a mechanism to account for the change in height to the shaving aid body 14, the razor cartridge 12 would be exposed and the lubricating function provided by the shaving aid body 14, inter alia, would be inhibited.

The present invention razor assembly 10 advantageously enables the shaving aid body 14 and razor cartridge 12 to maintain the original orientation between the contact surface 32 of the shaving aid body 14 and the razor blades 26 of the razor cartridge 12. Force applied by the user is approximately distributed to those portions of the razor cartridge 12 and shaving aid body 14 in contact with the surface to be shaved. As the shaving aid body 14 erodes and the contact surface 32 of the shaving aid body 14 consequently changes, the relative positions of the shaving aid body 14 and the razor cartridge 12 change. The orientation of the razor cartridge 12 and the contact surface 32 of the shaving aid body 14 does not change, however. The force applied to the razor assembly causes the razor cartridge 12 to move in the direction of arrow 88, and the linkage 18 to pivot. The pivotal (i.e., "seesaw") movement of the linkage 18 causes the shaving aid body 14 to travel in the direction of arrow 90; i.e., substantially opposite the direction of arrow 88. As a result, the shaving aid body contact surface 32 is maintained approximately co-planar with the cutting edges 30 of the one or more razor blades 26 within the razor cartridge 12.

In terms of the embodiment shown in FIGS. 1–3, movement of the razor cartridge 12 toward the interior of the handle 16 (i.e., arrow 88) causes the first link 38 to move in a clockwise direction. Clockwise movement of the first link 38 causes the pivot link 42 to also rotate in a clockwise direction. The clockwise rotation of the pivot link 42, in turn, causes the second link 40 to rotate in a counterclockwise direction. As a result, the shaving aid body 14 attached to the second link 40 moves away from the interior of the handle 16 (i.e., arrow 90).

Figure 4:
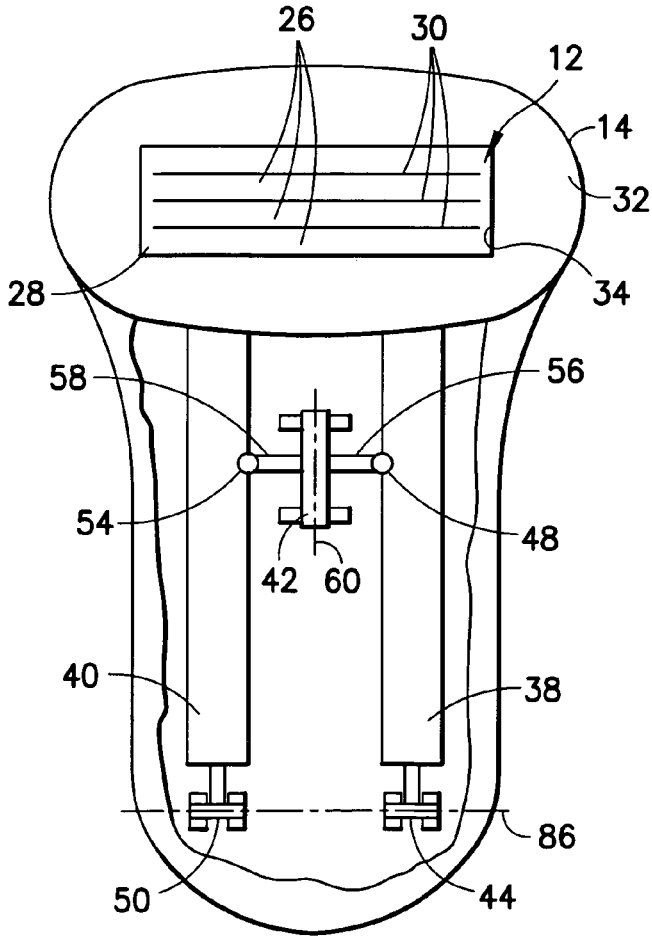
FIG. 4 is a diagrammatic front view of a present invention razor assembly, partially broken away to illustrate a second linkage embodiment.
Figure 5:
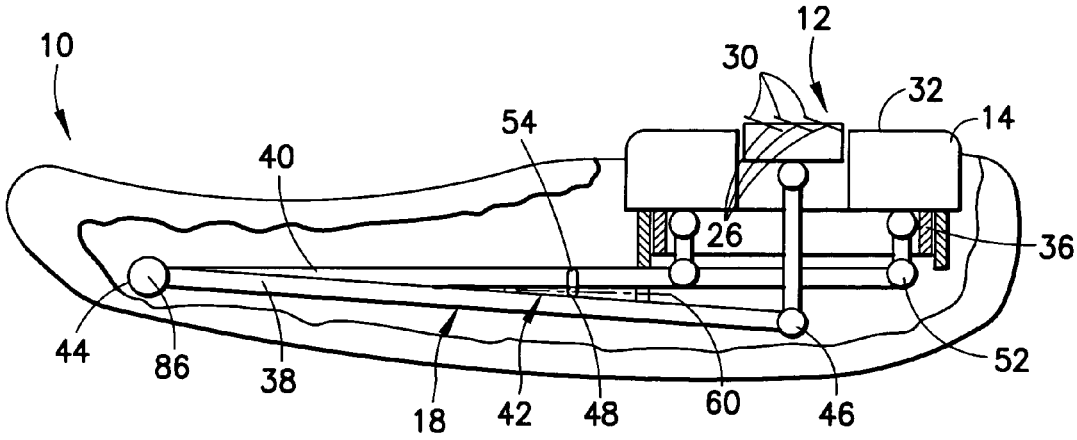
FIG. 5 is a diagrammatic side view of the present invention razor assembly including the second linkage embodiment.
Figure 6:
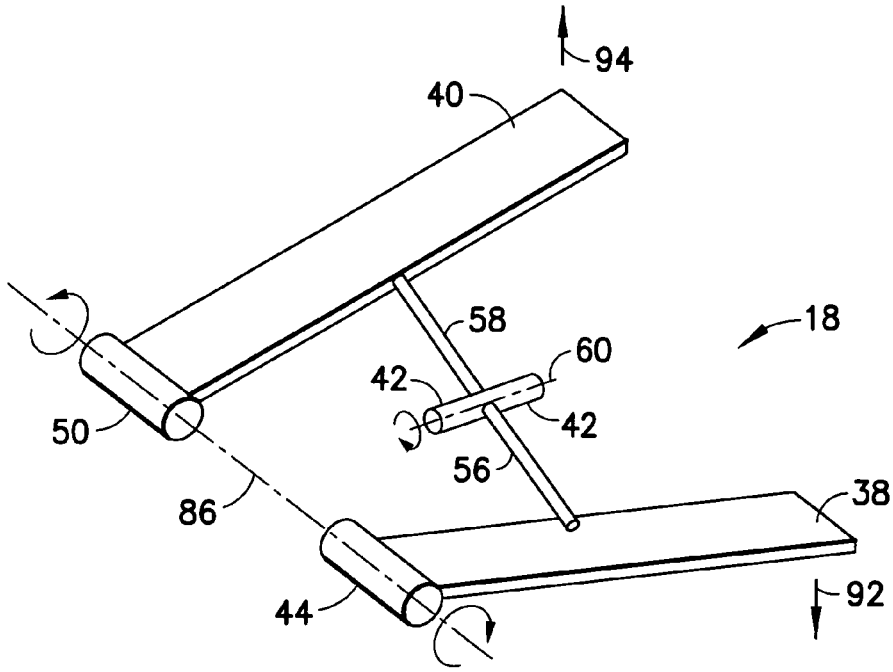
FIG. 6 is a diagrammatic illustration of the second linkage embodiment in a first position.

In terms of the embodiment shown in FIGS. 4–6, movement of the razor cartridge 12 toward the interior of the handle 16 (i.e., arrow 92) causes the first link 38 to move in a clockwise direction. Clockwise movement of the first link 38 causes the pivot link 42 to also rotate in a clockwise direction. The clockwise rotation of the pivot link 42, in turn, causes the second link 40 to rotate in a counterclockwise direction. As a result, the shaving aid body 14 attached to the second link 40 moves away from the interior of the handle 16.

Figure 7:
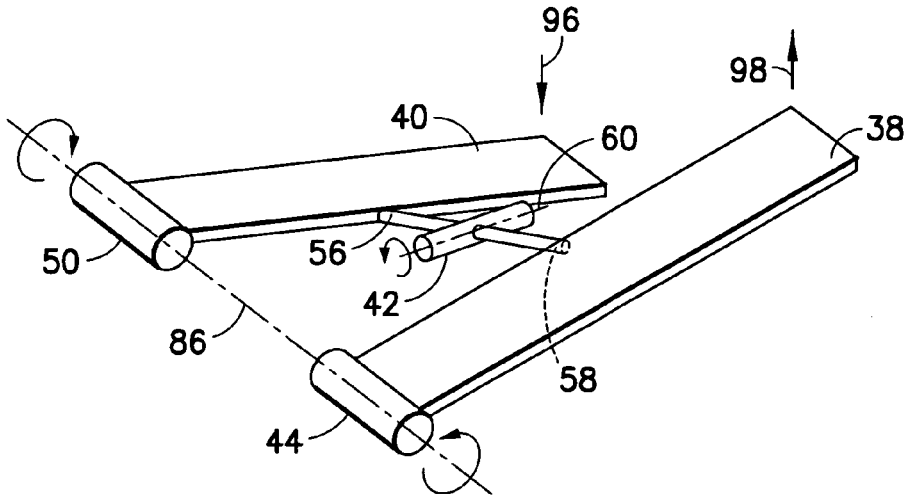
FIG. 7 is a diagrammatic illustration of the second linkage embodiment in a second position.

Referring to FIGS. 4, 5, and 7, movement of the shaving aid body 14 toward the interior of the handle 16 (i.e., arrow 96), conversely, causes the second link 40 to move in a clockwise direction. Clockwise movement of the second link 40 causes the pivot link 42 to rotate in a counterclockwise direction. The counterclockwise rotation of the pivot link 42, in turn, causes the first link 38 to rotate in a counterclockwise direction. As a result, the razor cartridge 12 attached to the first link 38 moves away from the interior of the handle 16 (i.e., arrow 98).

Although this invention has been shown and described with respect to the detailed embodiments thereof, it will be understood by those skilled in the art that various changes in form and detail thereof may be made without departing from the spirit and scope of the invention.

What is claimed is:

1. A razor assembly, comprising:

a razor cartridge that includes one or more razor blades;

a shaving aid body;

a handle; and a linkage including at least one first link having a first pivot end, at least one second link having a second pivot end, and at least one pivot link, the first and second pivot ends being pivotally attached to the handle and pivotable about a first axis extending through the first and second pivot ends;

wherein the razor cartridge is attached to the first link, and the shaving aid body is attached to the second link, and the pivot link being pivotally attached to the handle and pivotable about a second axis, and to the first link at a first point, and to the second link at a second point, the pivotal attachments being in a manner such that the razor cartridge and the shaving aid body are moveable relative to the handle, and movement of one of the razor cartridge and the shaving aid body in a first direction causes the other of the razor cartridge and the shaving aid body to move in a second direction substantially opposite the first direction.

2. The razor assembly of claim 1 wherein the linkage is indirectly connected to one or both of the razor cartridge and the shaving aid body.

3. The razor assembly of claim 1, wherein the shaving aid body is erodable, and the shaving aid body includes a contact surface, and wherein the linkage is actuatable to maintain a predetermined orientation between the contact surface and the razor cartridge as the shaving aid body erodes.

4. The razor assembly of claim 1, wherein each of the one or more razor blades has a cutting edge, and the shaving aid body has a contact surface; and wherein the shaving aid body is erodable; and wherein the linkage is operable to maintain the shaving plane approximately co-planar with the contact surface of the shaving aid body.

5. The razor assembly of claim 1 the second axis being substantially parallel to the first axis.

6. The razor assembly of claim 5, wherein the pivot link comprises at least one first-link arm and at least one second-link arm.

7. The razor assembly of claim 6, wherein the first-link arm and the second link arm are disposed on opposite sides of the second axis.

8. The razor assembly of claim 1 wherein the second axis is substantially perpendicular to the first axis.

9. The razor assembly of claim 8 wherein the linkage is indirectly connected to one or both of the razor cartridge and the shaving aid body.

10. The razor assembly of claim 8, wherein the shaving aid body is erodable, and the shaving aid body includes a contact surface, and wherein the linkage is actuatable to maintain a predetermined orientation between the contact surface and the razor cartridge as the shaving aid body erodes.

11. The razor assembly of claim 8, wherein each of the one or more razor blades has a cutting edge, and the shaving aid body has a contact surface; and wherein the shaving aid body is erodable; and wherein the linkage is operable to maintain the shaving plane approximately co-planar with the contact surface of the shaving aid body.

12. The razor assembly of claim 8, wherein the pivot link comprises at least one first-link arm and at least one second-link arm.

13. The razor assembly of claim 12, wherein the first-link aim and the second-link arm are disposed on opposite sides of the second axis.

* * * * *